US008669921B2

(12) United States Patent
Han

(10) Patent No.: US 8,669,921 B2
(45) Date of Patent: Mar. 11, 2014

(54) PLASMA DISPLAY APPARATUS AND METHOD OF DRIVING THE SAME

(75) Inventor: Junggwan Han, Gumi (KR)

(73) Assignee: LG Electronics Inc., Seoul (KR)

( * ) Notice: Subject to any disclaimer, the term of this patent is extended or adjusted under 35 U.S.C. 154(b) by 1018 days.

(21) Appl. No.: 12/694,508

(22) Filed: Jan. 27, 2010

(65) Prior Publication Data

US 2010/0265244 A1 Oct. 21, 2010

(30) Foreign Application Priority Data

Apr. 21, 2009 (KR) ..... 10-2009-0034483

(51) Int. Cl.
*G09G 3/294* (2013.01)
*G09G 3/296* (2013.01)

(52) U.S. Cl.
USPC ..... 345/60; 315/169.4

(58) Field of Classification Search
CPC ..... G09G 3/2927; G09G 3/294; G09G 3/296
USPC ..... 345/60; 315/169.4
See application file for complete search history.

(56) References Cited

U.S. PATENT DOCUMENTS

2006/0061521 A1* 3/2006 Kim ..... 345/60
2007/0080901 A1* 4/2007 Yang et al. ..... 345/63
2009/0085836 A1* 4/2009 An et al. ..... 345/60

* cited by examiner

*Primary Examiner* — William Boddie
*Assistant Examiner* — Alecia D English
(74) *Attorney, Agent, or Firm* — KED & Associates LLP

(57) ABSTRACT

A plasma display apparatus and a method of driving the same are disclosed. The plasma display apparatus includes a plasma display panel including a scan electrode and a sustain electrode that are positioned parallel to each other and a driver. The driver allows a change amount of a voltage difference between the scan electrode and the sustain electrode in a reset period of a subfield over time in a pattern hold mode in which a pattern of input video data remains in a previous pattern to be different from a change amount of a voltage difference between the scan electrode and the sustain electrode in a reset period of a subfield over time in a pattern change mode in which the pattern of the video data changes.

11 Claims, 17 Drawing Sheets

PLASMA DISPLAY APPARATUS AND METHOD OF DRIVING THE SAME

This application claims the benefit of Korean Patent Application No. 10-2009-0034483 filed on Apr. 21, 2009, the entire contents of which is incorporated herein by reference for all purposes as if fully set forth herein.

BACKGROUND OF THE INVENTION

1. Field of the Invention

Embodiments of the invention relate to a plasma display apparatus and a method of driving the same.

2. Discussion of the Related Art

A plasma display apparatus includes a plasma display panel. The plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a plasma display apparatus comprising a plasma display panel including a scan electrode and a sustain electrode that are positioned parallel to each other, and a driver that allows a change amount of a voltage difference between the scan electrode and the sustain electrode in a reset period of a subfield over time in a pattern hold mode in which a pattern of input video data remains in a previous pattern to be different from a change amount of a voltage difference between the scan electrode and the sustain electrode in a reset period of a subfield over time in a pattern change mode in which the pattern of the video data changes.

The change amount of the voltage difference between the scan electrode and the sustain electrode in the reset period over time in the pattern hold mode may be less than the change amount of the voltage difference between the scan electrode and the sustain electrode in the reset period over time in the pattern change mode.

A change amount of a voltage difference between the scan electrode and the sustain electrode in the reset period over time in a first half period of a period operating in the pattern hold mode may be greater than a change amount of a voltage difference between the scan electrode and the sustain electrode in the reset period over time in a second half period of the period operating in the pattern hold mode.

The voltage difference between the scan electrode and the sustain electrode in the reset period over time may decrease in the pattern hold mode, and the voltage difference between the scan electrode and the sustain electrode in the reset period over time may increase in the pattern change mode.

When a voltage difference between the scan electrode and the sustain electrode in a reset period of a first subfield of a first frame of a plurality of frames is a first value, a voltage difference between the scan electrode and the sustain electrode in a reset period of a first subfield of a second frame following the first frame is a second value, a voltage difference between the scan electrode and the sustain electrode in a reset period of a first subfield of a third frame following the second frame is a third value, and a voltage difference between the scan electrode and the sustain electrode in a reset period of a first subfield of a fourth frame following the third frame is a fourth value, a difference between the first value and the second value may be greater than a difference between the second value and the third value and a difference between the third value and the fourth value.

The first subfield of the first frame, the first subfield of the second frame, the first subfield of the third frame, and the first subfield of the fourth frame may have the same weight value and may be arranged in the same location in the corresponding frame.

The first, second, third, and fourth frames may be arranged in the order named.

The difference between the first value and the second value may be equal to a sum of the difference between the second value and the third value and the difference between the third value and the fourth value.

The pattern of the video data may change between the first and second frames and then may remain in the pattern changing between the first and second frames during the second, third, and fourth frames.

In another aspect, there is a plasma display apparatus comprising a plasma display panel including a scan electrode and a sustain electrode that are positioned parallel to each other, and a driver that adjusts a voltage difference between the scan electrode and the sustain electrode in a reset period of at least one of a plurality of subfields depending on whether or not a pattern of input video data changes.

When the pattern of the video data changes, the driver may increase the voltage difference between the scan electrode and the sustain electrode in the reset period of the at least one of the plurality of subfields.

When a number of discharge cells having changed data among a plurality of discharge cells is greater than a reference value, it may be decided by the driver that the pattern of the video data changes.

The driver may allow a voltage difference between the scan electrode and the sustain electrode in a reset period of one of two subfields of the plurality of subfields to be different from a voltage difference between the scan electrode and the sustain electrode in a reset period of the other subfield depending on whether or not the pattern of the video data changes.

When the two subfields include first and second subfields, the first subfield and the second subfield are included in different frames.

The first subfield and the second subfield may be first subfields of the different frames.

When a voltage difference between the scan electrode and the sustain electrode in a reset period of the first subfield is greater than a voltage difference between the scan electrode and the sustain electrode in a reset period of the second subfield, a method according to the first subfield may be used in a pattern change mode in which the pattern of the video data changes and a method according to the second subfield may be used in a pattern hold mode in which the pattern of the video data remains in a previous pattern.

In another aspect, there is a method of driving a plasma display apparatus including a scan electrode and a sustain electrode positioned parallel to each other, the method comprising reducing a voltage of a reset signal supplied to the scan electrode during a partial period of a reset period of a subfield in a pattern hold mode in which a pattern of input video data remains in a previous pattern, and increasing the voltage of the reset signal supplied to the scan electrode during a partial period of the reset period of the subfield in a pattern change mode in which the pattern of the video data changes.

A change amount of the voltage of the reset signal over time in the pattern change mode may be greater than a change amount of the voltage of the reset signal over time in the pattern hold mode.

The reset signal may include a rising signal gradually rising from a reference voltage. The reset period may include a period in which the reset signal is held at the reference voltage and a voltage of the rising signal decreases in the pattern hold mode. The reset period may include a period in which the reset signal is held at the reference voltage and the voltage of the rising signal increases in the pattern change mode.

The reset signal may include a rising signal gradually rising from a reference voltage. The reset period may include a period in which a voltage magnitude of the rising signal is held and the reference voltage decreases in the pattern hold mode. The reset period may include a period in which the voltage magnitude of the rising signal is held and the reference voltage increases in the pattern change mode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
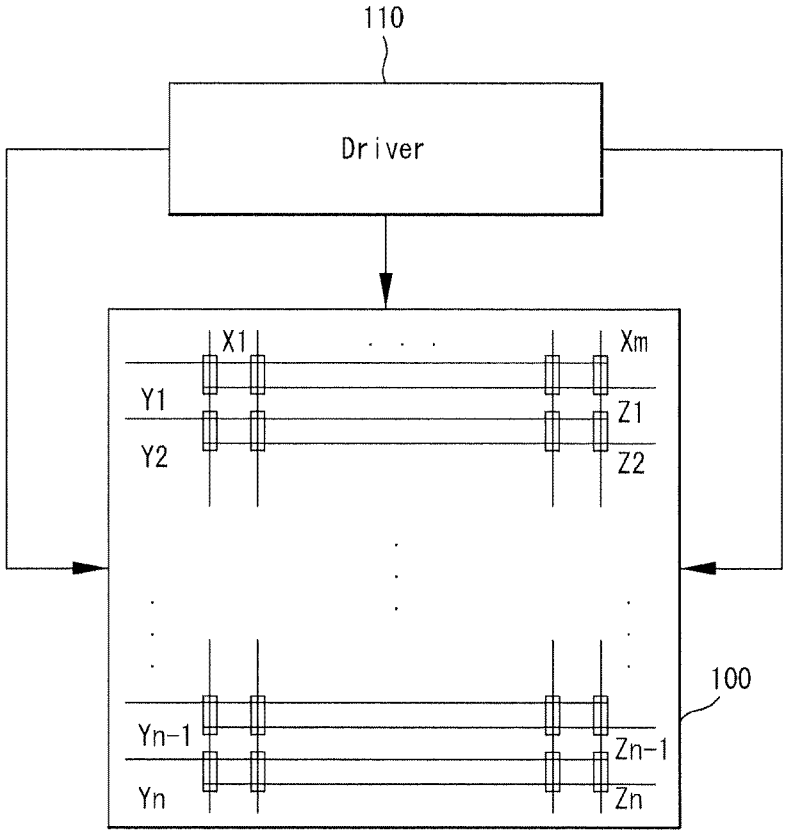
FIG. 1 illustrates an exemplary configuration of a plasma display apparatus according to an embodiment of the invention.

FIG. 1 illustrates an exemplary configuration of a plasma display apparatus according to an embodiment of the invention.

As shown in FIG. 1, the plasma display apparatus according to the exemplary embodiment may include a plasma display panel 100 and a driver 110.

The plasma display panel 100 may include scan electrodes Y1 to Yn and sustain electrodes Z1 to Zn positioned parallel to each other, and address electrodes X1 to Xm positioned to cross the scan electrodes Y1 to Yn and the sustain electrodes Z1 to Zn. The plasma display panel 100 may display an image in a frame including a plurality of subfields.

The driver 110 may supply driving signals to at least one of the scan electrodes Y1 to Yn, the sustain electrodes Z1 to Zn, or the address electrodes X1 to Xm and allow the image to be displayed on the screen of the plasma display panel 100. Preferably, the driver 110 may allow voltage differences between the scan electrode and the sustain electrode of the plasma display panel 100 during reset periods of any two subfields of the plurality of subfields to be different from each other.

Although FIG. 1 shows the driver 110 formed in the form of a signal board, the driver 110 may be formed in the form of a plurality of boards depending on the electrodes of the plasma display panel 100. For example, the driver 110 may include a first driver (not shown) for driving the scan electrodes Y1 to Yn, a second driver for driving the sustain electrodes Z1 to Zn, and a third driver (not shown) for driving the address electrodes X1 to Xm.

Figure 2:
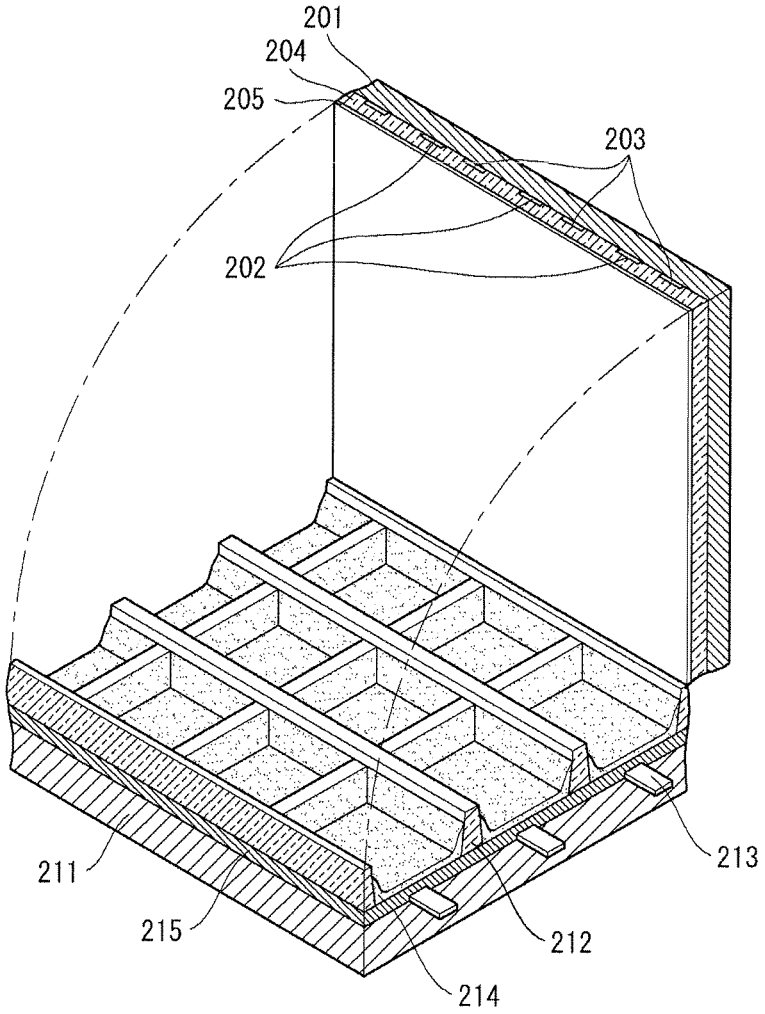
FIG. 2 illustrates an exemplary structure of a plasma display panel.

FIG. 2 illustrates an exemplary structure of the plasma display panel 100.

As shown in FIG. 2, the plasma display panel may include a front substrate 201, on which a scan electrode 202 and a sustain electrode 203 are formed substantially parallel to each other, and a rear substrate 211 on which an address electrode 213 is formed to cross the scan electrode 202 and the sustain electrode 203.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203. A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to partition discharge spaces (i.e., discharge cells). Hence, a first discharge cell emitting red light, a second discharge cell emitting blue light, and a third discharge cell emitting green light, etc. may be formed between the front substrate 201 and the rear substrate 211. Each of the barrier ribs 212 may include first and second barrier ribs each having a different height.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells partitioned by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be formed inside the discharge cells.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be larger than a width or thickness of the address electrode 213 outside the discharge cell.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

Figure 3:
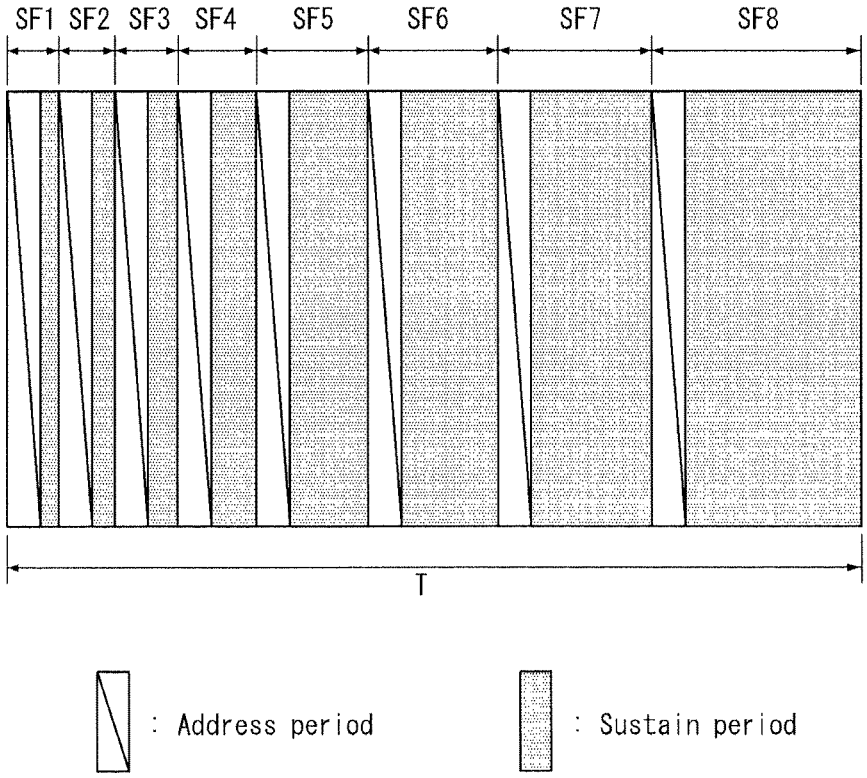
FIG. 3 illustrates a frame for achieving a gray scale of an image.

FIG. 3 illustrates a frame for achieving a gray scale of an image.

As shown in FIG. 3, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 3, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at $2^0$ and a gray level of a second subfield at $2^1$, the sustain period increases in a ratio of $2^n$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 3 shows that one frame includes 8 subfields, the number of subfields constituting a frame may vary. For example, a frame may include 10 or 12 subfields. Further, although FIG. 3 shows that the subfields of the frame are arranged in increasing order of gray level weight, the subfields may be arranged in decreasing order of gray level weight or may be arranged regardless of gray level weight.

At least one of a plurality of subfields of a frame may be a selective erase subfield, or at least one of the plurality of subfields of the frame may be a selective write subfield.

If a frame includes at least one selective erase subfield and at least one selective write subfield, it may be preferable that a first subfield or first and second subfields of a plurality of subfields of the frame is/are a selective write subfield and the other subfields are selective erase subfields.

In the selective erase subfield, a discharge cell to which a data signal is supplied during an address period is turned off during a sustain period following the address period. In other words, the selective erase subfield may include an address period, during which a discharge cell to be turned off is selected, and a sustain period during which a sustain discharge occurs in the discharge cell that is not selected during the address period.

In the selective write subfield, a discharge cell to which a data signal is supplied during an address period is turned on during a sustain period following the address period. In other words, the selective write subfield may include a reset period during which discharge cells are initialized, an address period during which a discharge cell to be turned on is selected, and a sustain period during which a sustain discharge occurs in the discharge cell selected during the address period.

Figure 4:
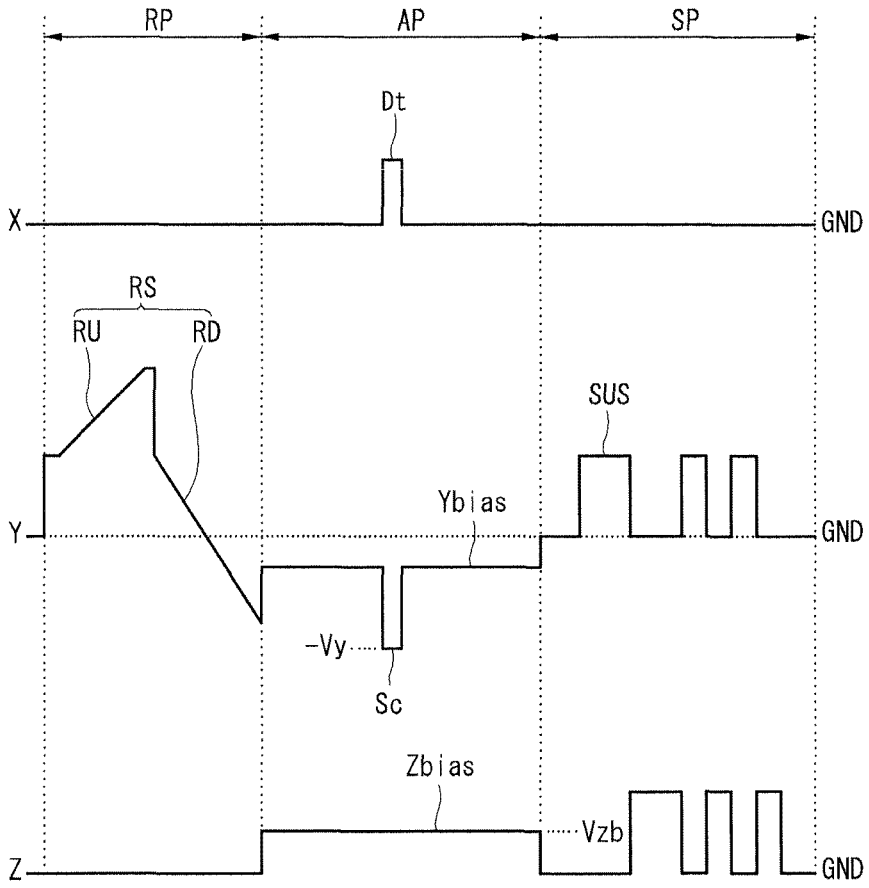
FIG. 4 illustrates an exemplary driving waveform of a plasma display apparatus.

FIG. 4 illustrates an exemplary driving waveform of the plasma display apparatus. A driving waveform to be described later is supplied by the driver 110 of FIG. 1.

As shown in FIG. 4, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.3 μs, 2.1 μs, . . . , 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS may be supplied to at least one of the scan electrode Y or the sustain electrode Z. For example, the sustain signal SUS is alternately supplied to the scan electrode Y and the sustain electrode Z. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

An image may be displayed on the plasma display panel through the above-described driving method.

FIGS. 5 to 8 illustrate an exemplary method of driving the plasma display apparatus.

Voltage differences between the scan electrode and the sustain electrode in reset periods of the same subfields in any two frames of a plurality of frames are different from each other. Preferably, differences between maximum voltages of the scan electrode and the sustain electrode during reset periods of the same subfields of any two frames may be different from each other.

Figure 5:
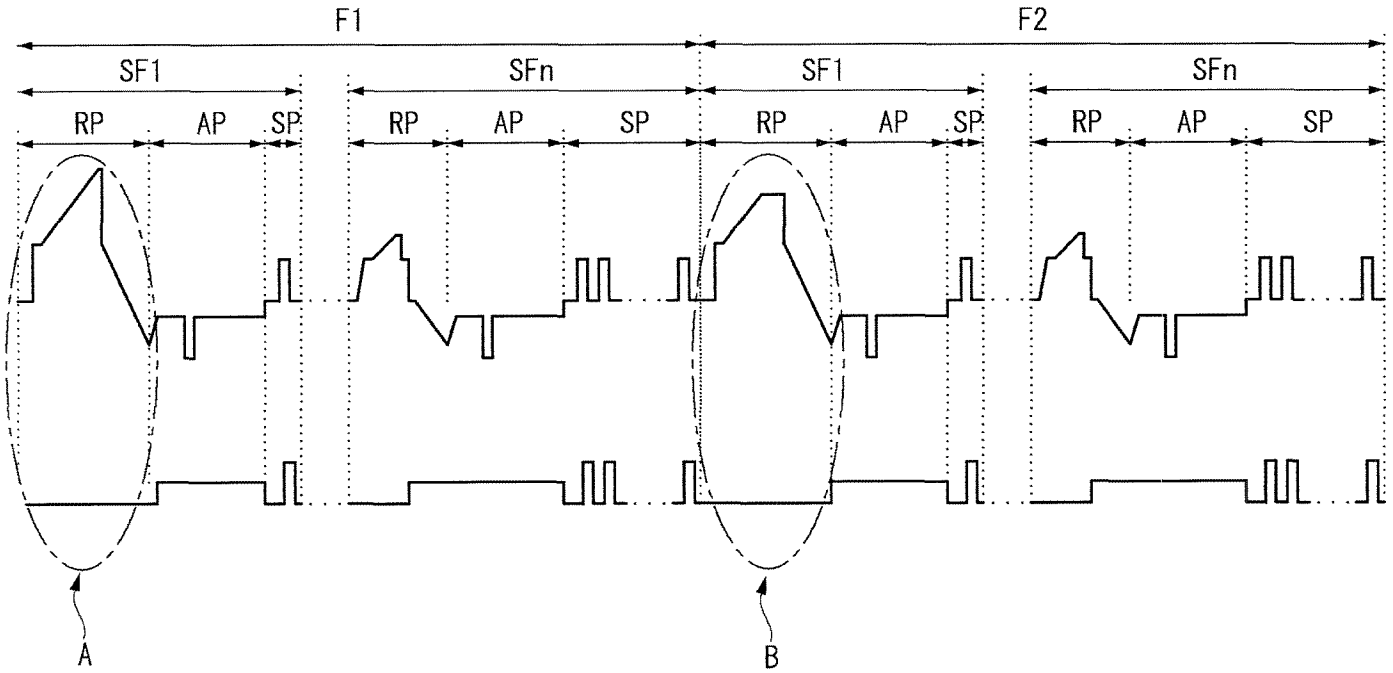
FIGS. 5 to 8 illustrate an exemplary method of driving a plasma display apparatus.

For example, as shown in FIG. 5, average power levels (APLs) of first and second frames F1 and F2 of a plurality of frames may be substantially equal to each other. In this case, a voltage difference between the scan electrode and the sustain electrode in a reset period RP of a first subfield SF1 of the first frame F1 may be different from a voltage difference between the scan electrode and the sustain electrode in a reset period RP of a first subfield SF1 of the second frame F2. The first subfield SF1 of the first frame F1 and the first subfield SF1 of the second frame F2 may have the same weight value and may be arranged in the same location in the corresponding frame.

For example, a voltage difference between the scan electrode and the sustain electrode in a reset period of a first subfield of a plurality of subfields constituting a first frame may be different from a voltage difference between the scan electrode and the sustain electrode in a reset period of a first subfield of a plurality of subfields constituting a second frame.

Figure 6:
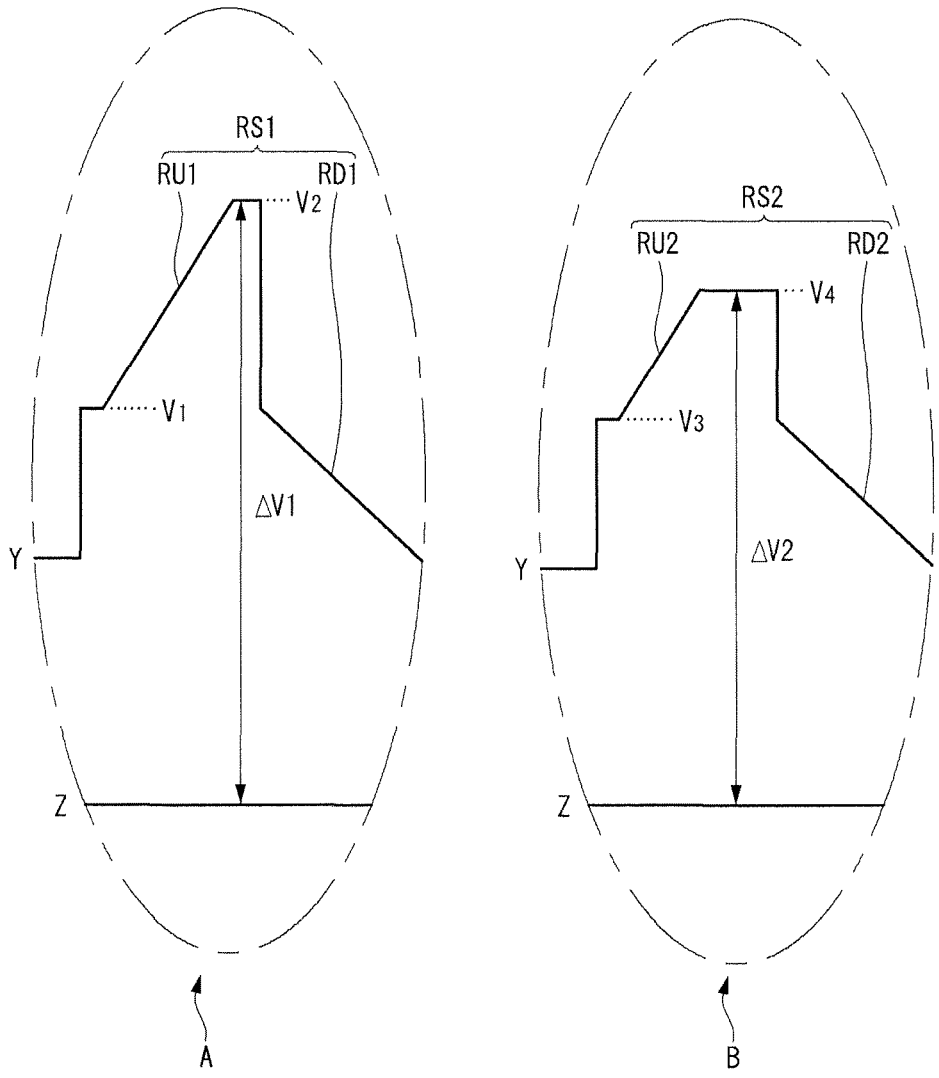

For this, as shown in FIG. 6, a maximum voltage V2 of a first reset signal RS1 supplied to the scan electrode Y in the reset period RP of the first subfield SF1 of the first frame F1 may set to be greater than a maximum voltage V4 of a second reset signal RS2 supplied to the scan electrode Y in the reset period RP of the first subfield SF1 of the second frame F2. In other words, a voltage difference ΔV1 between the scan electrode Y and the sustain electrode Z in the reset period RP of the first subfield SF1 of the first frame F1 may be greater than a voltage difference ΔV2 between the scan electrode Y and the sustain electrode Z in the reset period RP of the first subfield SF1 of the second frame F2 because the maximum voltage V2 of the first reset signal RS1 is greater than the maximum voltage V4 of the second reset signal RS2.

As above, when the voltage differences between the scan electrode Y and the sustain electrode Z in the reset periods RP of the first subfields SF1 of the first and second frames F1 and F2 are different from each other, a strong reset discharge may occur during the reset period RP of the first subfield SF1 of the first frame F1 because of the relatively large voltage difference V1 between the scan electrode Y and the sustain electrode Z in the reset period RP of the first subfield SF1 of the first frame F1. Hence, wall charges may be uniformly distributed in the discharge cells. As a result, a driving margin may increase.

Further, an amount of visible light generated by a reset discharge occurring during the reset period may decrease because of the relatively small voltage difference ΔV2 between the scan electrode Y and the sustain electrode Z in the reset period RP of the first subfield SF1 of the second frame F2. Hence, contrast characteristic of an image may be improved.

If there are relatively large voltage differences between the scan electrode Y and the sustain electrode Z in reset periods of first subfields of all of a plurality of frames in the same manner as the voltage difference ΔV1 in the first subfield SF1 of the first frame F1 illustrated in FIG. 6, reset discharges in all of the frames may be stabilized, and a driving margin in all of the frames may increase. However, because an amount of light generated during the reset periods of all of the frames sharply increases, the contrast characteristic of the image may be excessively reduced.

Further, if there are relatively small voltage differences between the scan electrode Y and the sustain electrode Z in reset periods of first subfields of all of a plurality of frames in the same manner as the voltage difference ΔV2 in the first subfield SF1 of the second frame F2 illustrated in FIG. 6, the contrast characteristic of the image may be improved by reducing an amount of light generated during the reset periods of all of the frames. However, the wall charges may be nonuniformly distributed in the discharge cells, and thus the driving margin may worsen.

On the other hand, in the embodiment of the invention, because the relatively large voltage difference ΔV1 is provided in the first subfield SF1 of the first frame F1 and the relatively small voltage difference ΔV2 is provided in the first subfield SF1 of the second frame F2, the contrast characteristic may be improved while the reset discharge are stabilized and the driving margin is improved.

It may be preferable that a voltage difference between the scan electrode Y and the sustain electrode Z in a reset period of a first subfield of a plurality of subfields constituting a frame is greater than voltage differences between the scan electrode Y and the sustain electrode Z in reset periods of the other subfields, so as to sufficiently reduce an amount of light generated during the reset periods and to improve the contrast characteristic. For example, a voltage difference between the scan electrode Y and the sustain electrode Z in a reset period of a first subfield of a plurality of subfields constituting a first frame may be greater than a voltage difference between the scan electrode Y and the sustain electrode Z in a reset period of a first subfield of a plurality of subfields constituting a second frame.

Figure 7:
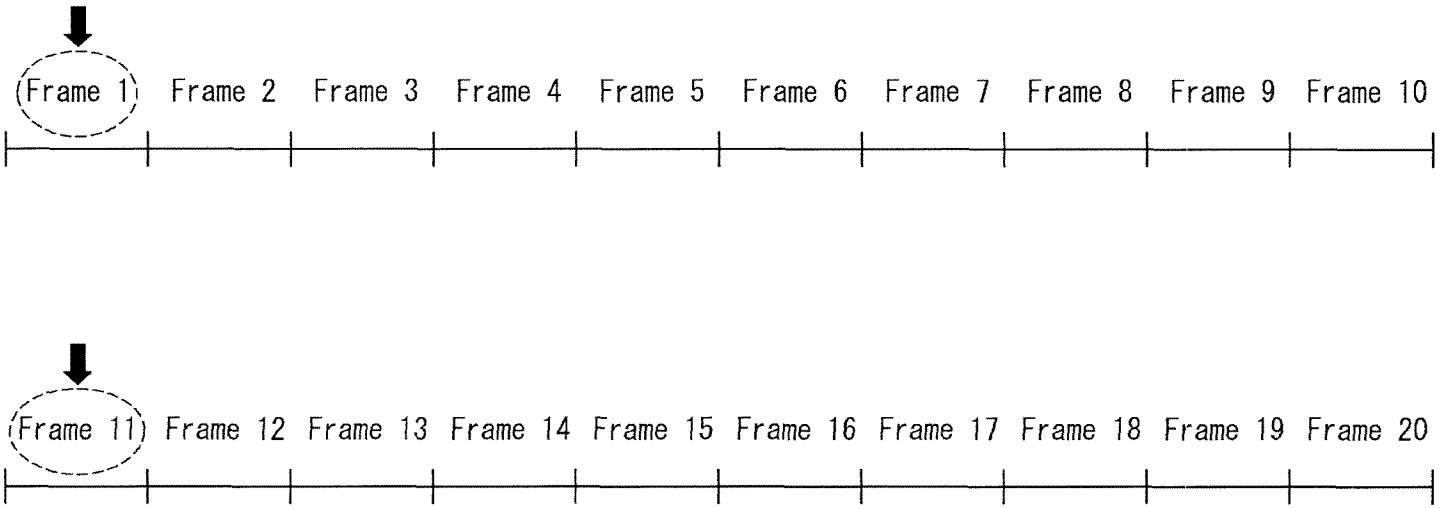

Further, a frame including a subfield, in which a voltage difference between the scan electrode Y and the sustain electrode Z is relatively large, may be repeatedly arranged every predetermined time interval. For example, as shown in FIG. 7, a frame including a subfield, in which a voltage difference between the scan electrode Y and the sustain electrode Z is relatively large, may be repeatedly arranged every 10 frames. In other words, in FIG. 7, voltage differences between the scan electrode Y and the sustain electrode Z in reset periods of first subfields of first and 11th frames are relatively large.

Furthermore, voltage differences between the scan electrode Y and the sustain electrode Z in reset periods of a plurality of subfields of a frame may be relatively large.

Figure 8:
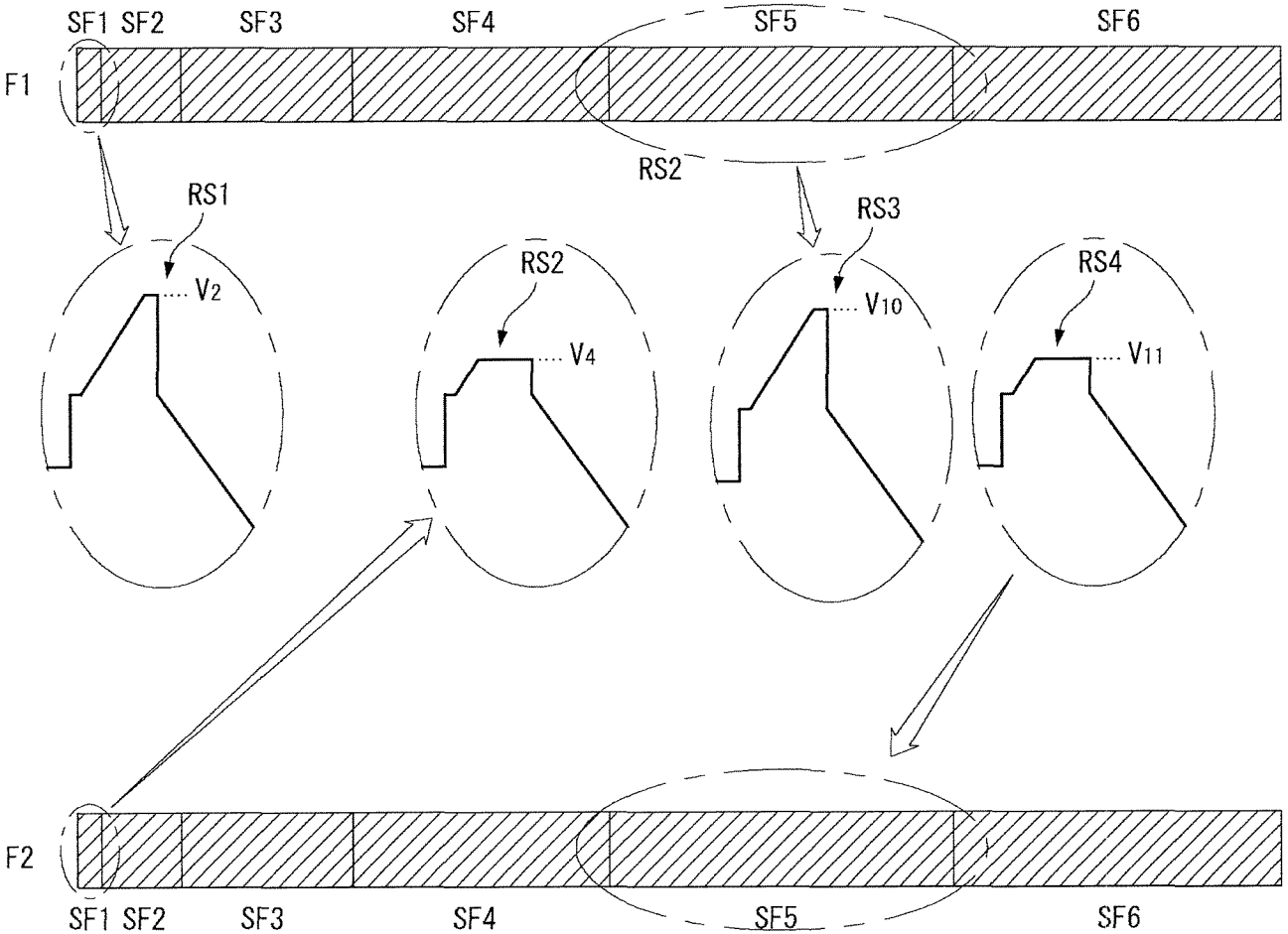

For example, as shown in FIG. 8, a first reset signal RS1 having a maximum voltage V2 may be provided in a first subfield SF1 of a first frame F1, and a second reset signal RS2 having a maximum voltage V4 less than the maximum voltage V2 may be provided in a first subfield SF1 of a second frame F2. Further, a third reset signal RS3 having a maximum voltage V10 may be provided in a fifth subfield SF5 of the first frame F1, and a fourth reset signal RS4 having a maximum voltage V11 less than the maximum voltage V10 may be provided in a fifth subfield SF5 of the second frame F2. In FIG. 8, the maximum voltage V2 of the first reset signal RS1 and the maximum voltage V10 of the third reset signal RS3 may be substantially equal to each other, and the maximum voltage V4 of the second reset signal RS2 and the maximum voltage V11 of the fourth reset signal RS4 may be substantially equal to each other.

Figure 9:
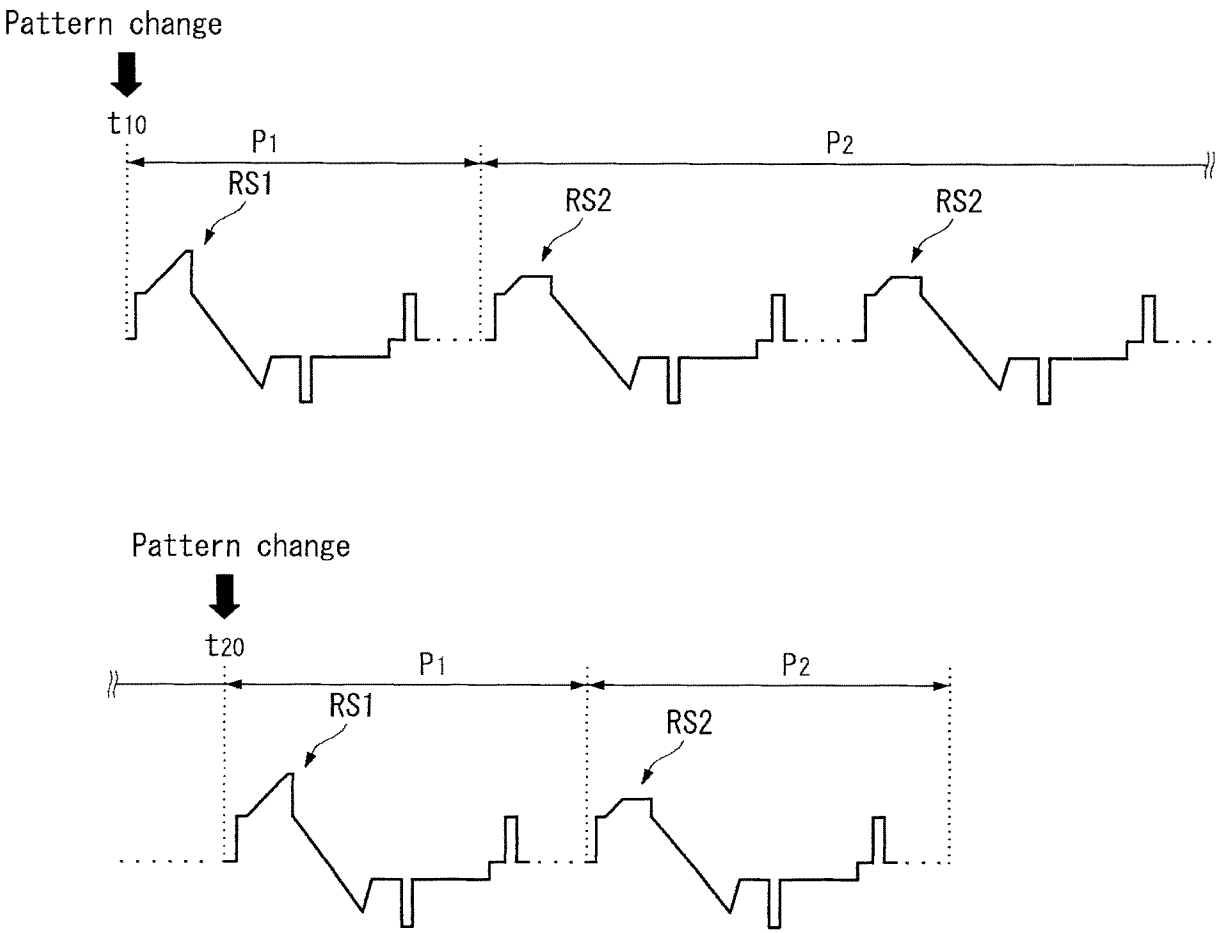
FIGS. 9 to 11 illustrate an exemplary method of driving a plasma display apparatus according to changes in a pattern of video data.
Figure 10:
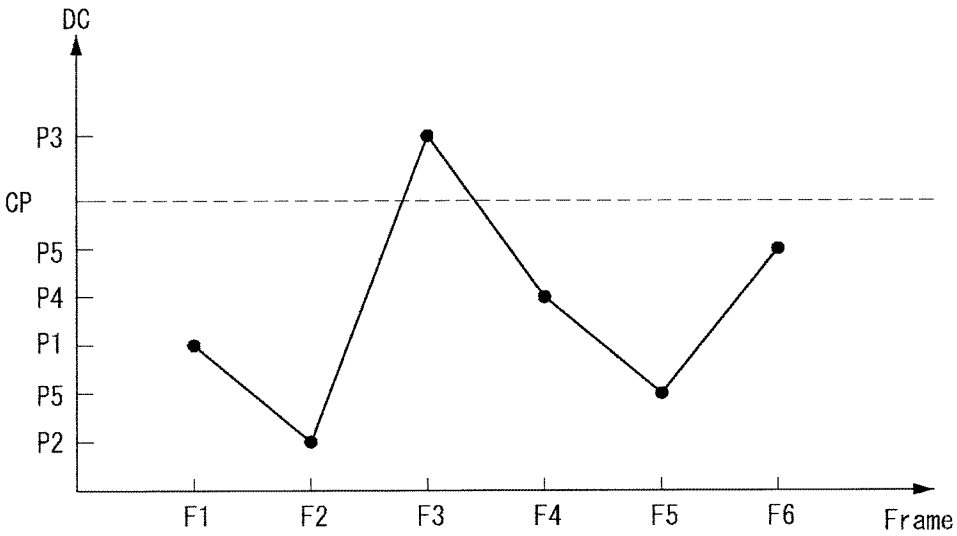
Figure 11:
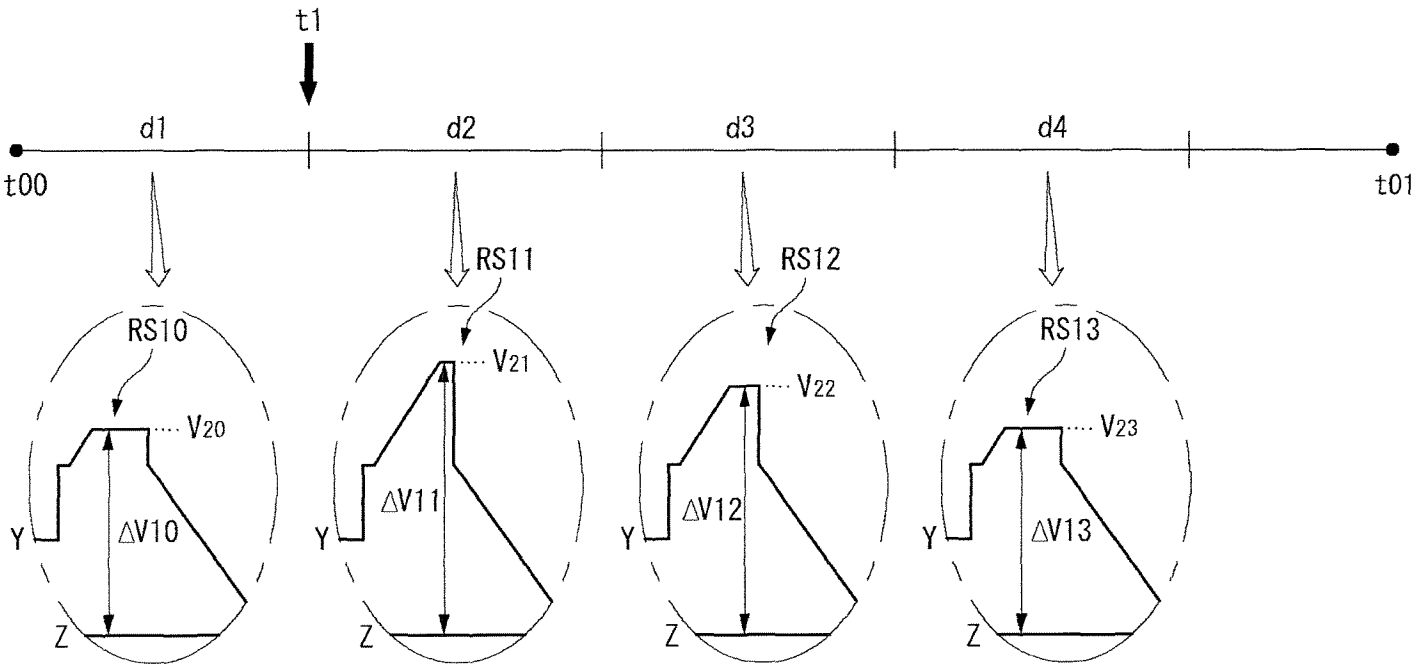

FIGS. 9 to 11 illustrate an exemplary method of driving a plasma display apparatus according to changes in a pattern of video data. The description of structures and components identical or equivalent to those illustrated above may be briefly made or may be entirely omitted.

As shown in FIG. 9, a voltage difference between the scan electrode and the sustain electrode in a reset period of at least one subfield of a frame may be adjusted depending on whether or not a pattern of input video data changes. A method for adjusting a voltage difference between the scan electrode and the sustain electrode in a reset period is described with reference to FIGS. 5 to 8.

Preferably, when a pattern of input video data changes, a voltage difference between the scan electrode and the sustain electrode in a reset period of at least one subfield of a plurality of subfields constituting a frame may increase.

In the embodiment, when the number of discharge cells having changed data among the plurality of discharge cells is greater than a reference value, it is decided that a pattern of video data changed. Hence, a voltage difference between the scan electrode and the sustain electrode in a reset period of at least one subfield of a frame may increase according to the pattern change of video data.

For example, it is assumed that a first reset signal RS1 is supplied to the scan electrode so that a voltage difference between the scan electrode and the sustain electrode in a reset period of a first subfield of a first frame of a plurality of frames has a first value (for example, ΔV1 of FIG. 6) and a second reset signal RS2 is supplied to the scan electrode so that a voltage difference between the scan electrode and the sustain electrode in a reset period of a first subfield of a second frame of the plurality of frames has a second value (for example, ΔV2 of FIG. 6).

A method applied to the first frame and a method applied to the second frame may be selectively used depending on whether or not a pattern of video data changes.

Preferably, when the pattern of video data changes, the first frame method, in which the relatively large voltage difference is provided, may be used. When the pattern of input video data does not change, the second frame method, in which the relatively small voltage difference is provided, may be used.

For example, it is assumed that a pattern of video data changes at time points t10 and t20 in FIG. 9. In this case, the first frame method may be used at the time points t10 and t20.

The pattern change of input video data may indicate that different images are achieved in two successive frames at a time when the pattern of video data changes. Further, the pattern change of input video data may indicate that distribution states of wall charges in the two successive frames are different from each other. Thus, a strong reset operation may be necessary so as to smoothly display the different images.

When the pattern of video data changes at the time points t10 and t20, a strong and stable reset discharge may occur in the reset period using the first frame method, in which the relatively large voltage difference is provided. In this case, the driving margin may be improved.

On the other hand, when the pattern of video data does not change and remains in a previous pattern, images having similar characteristic may be continuously displayed. Thus, even if a relatively weak reset discharge occurs, a sufficient reset operation may be performed. In other words, when the pattern of video data does not change and remains in the previous pattern, the second frame method, in which the relatively small voltage difference is provided, may be used.

If the first frame method is used when the pattern of video data does not change and remains in the previous pattern, the driving margin may be improved. However, an improvement width of the driving margin may be slight, and an amount of visible light generated during the reset period may unnecessarily increase. Hence, the contrast characteristic may worsen.

Further, the first frame method or the second frame method may be used during a predetermined period of time from the time point of the pattern change of video data.

For example, as shown in FIG. 9, the first frame method may be used during a period P1 from the time point t10 when the pattern of video data changes, and the second frame method may be used during a period P2 following the period P1. In FIG. 9, the first frame method may be used during at least ten frames.

In the embodiment of the invention, a data change amount between two successive frames may determine whether or not the pattern of video data changes.

For example, when first and second frames each having different data are successively arranged, an image in the first frame may be different from an image in the second frame. In other words, it seems that video data changed in the second frame.

Alternatively, when a change amount of video data in the second frame based on video data of the first frame is greater than a critical change amount, it seems that the video data changed in the second frame. For example, when the critical change amount is set to about 50% and a change percentage of the video data of the second frame based on the video data of the first frame is equal to or greater than 50%, it seems that the video data changed in the second frame.

For example, as shown in FIG. 10, when a change amount of video data in a first frame F1 based on video data of a frame prior to the first frame F1 is P1 smaller than a reference value CP, it may be decided that the video data did not change in the first frame F1. Further, when a change amount of video data in a second frame F2 based on the video data of the first frame F1 is P2 smaller than the reference value CP, it may be decided that the video data did not change in the second frame F2.

On the other hand, when a change amount of video data in a third frame F3 based on the video data of the second frame F2 is P3 greater than the reference value CP, it may be decided that the video data changed in the third frame F3. Hence, a voltage difference between the scan electrode and the sustain electrode increase in a reset period of a first subfield of the third frame F3.

On the other hand, a voltage difference between the scan electrode and the sustain electrode in a reset period of a first subfield of each of the first and second frames F1 and F2 may be less than the voltage difference between the scan electrode and the sustain electrode in the third frame F3.

Alternatively, in the embodiment of the invention, a change amount of an average power level (APL) may determine whether or not the pattern of video data changes. For example, when a difference between an APL of a second frame and an APL of a first frame prior to the second frame is greater than a previously determined critical value, it seems that the video data changed in the second frame.

Preferably, if video data according to a motion picture is provided, a pattern change mode may be set and thus a voltage difference between the scan electrode and the sustain electrode in a reset period may be relatively large. If video data according to a stop motion is provided, a pattern hold mode may be set and thus a voltage difference between the scan electrode and the sustain electrode in a reset period may be relatively small. The pattern change mode is a method in which the voltage difference between the scan electrode and the sustain electrode in the reset period has a relatively large value. The pattern hold mode is a method in which the voltage difference between the scan electrode and the sustain electrode in the reset period has a relatively small value.

More specifically, when video data of successively arranged first and second frames is substantially equal to each other, the pattern hold mode may operate. When video data of the successively arranged first and second frames is not equal to each other, the pattern change mode may operate. Even if the video data of the first and second frames is substantially equal to each other but the video data of the first frame or the second frame slightly changes because of a noise, etc., it may be considered that that the video data of the first and second frames is substantially equal to each other.

Further, when average power levels of successively arranged first and second frames are substantially equal to each other, the pattern hold mode may operate. When average power levels of the successively arranged first and second frames are not equal to each other, the pattern change mode may operate.

A channel change operation, a power-on operation, etc. may be excluded from the pattern change mode of video data. Because the channel change operation, the power-on operation, etc. are discontinuous image display operations, there is sufficient time to perform each of the discontinuous image display operations.

On the other hand, when video data according to a motion picture is input in a continuous image display operation, the pattern change mode may operate because the continuous image display operation does not have a pause period, in which an image is not displayed, and frames are continuously input in the continuous image display operation. Hence, the driving margin may be improved.

Alternatively, as shown in FIG. 11, a change amount of a voltage difference between the scan electrode and the sustain electrode over time in the pattern hold mode may be less than a change amount of a voltage difference between the scan electrode and the sustain electrode over time in the pattern change mode. In other words, the voltage difference between the scan electrode and the sustain electrode in the pattern change mode greatly changes over time, and the voltage difference between the scan electrode and the sustain electrode in the pattern hold mode slightly changes over time.

For example, as shown in FIG. 11, in a process in which an image is displayed during a period ranging from a time point t00 to a time point t01, a pattern of video data changes at a time point t1, and a voltage difference between the scan electrode and the sustain electrode changes in a reset period of a first subfield of a frame.

In a first period d1 prior to the time point t1, a reset signal RS10 having a maximum voltage V20 is supplied to the scan electrode in a first subfield of a frame, and thus a voltage difference between the scan electrode and the sustain electrode may have a first value ΔV10.

In a second period d2 following the time point t1, a reset signal RS11 having a maximum voltage V21 greater than the voltage V20 is supplied to the scan electrode in a first subfield of a frame because the pattern of video data changed, and thus a voltage difference between the scan electrode and the sustain electrode may have a second value ΔV11 greater than the first value ΔV10.

Subsequently, in a third period d3 of the pattern hold mode following the second period d2, a reset signal RS12 having a maximum voltage V22 less than the voltage V21 is supplied to the scan electrode in a first subfield of a frame, and thus a voltage difference between the scan electrode and the sustain electrode may have a third value ΔV12 less than the second value ΔV11.

Subsequently, in a fourth period d4 of the pattern hold mode following the third period d3, a reset signal RS13 having a maximum voltage V23 less than the voltage V22 is supplied to the scan electrode in a first subfield of a frame, and thus a voltage difference between the scan electrode and the sustain electrode may have a fourth value ΔV13 less than the third value ΔV12.

In this case, a difference between the first and second values ΔV10 and ΔV11 may be greater than a difference between the second and third values ΔV11 and ΔV12 and a difference between the third and fourth values ΔV12 and ΔV13. Further, a magnitude of the voltage difference between the scan electrode and the sustain electrode rapidly increases but slowly decreases.

In a method illustrated in FIG. 11, a reset operation in the pattern change mode may be effectively performed, and the image quality may be prevented from worsening by preventing a sharp change of a luminance in the pattern hold mode.

In the method illustrated in FIG. 11, each of the second and third periods d2 and d3 may include at least 10 frames.

Further, the maximum voltage V23 of the reset signal RS13 in the fourth period d4 and the maximum voltage V20 of the reset signal RS10 in the first period d1 may be substantially equal to each other. In other words, the difference between the first and second values ΔV10 and ΔV11 may be equal to a sum of the difference between the second and third values ΔV11 and ΔV12 and the difference between the third and fourth values ΔV12 and ΔV13. As a result, the voltage difference between the scan electrode and the sustain electrode starts to decrease after the pattern change period (i.e., the second period d2) of video data, and then is recovered to a voltage difference level in a period (i.e., the first period d1) prior to the pattern change period of video data.

In other words, a voltage difference between the scan electrode and the sustain electrode in a reset period may decrease in a pattern hold mode of video data, and a voltage difference between the scan electrode and the sustain electrode in a reset period may increase in a pattern change mode of video data.

Figure 12:
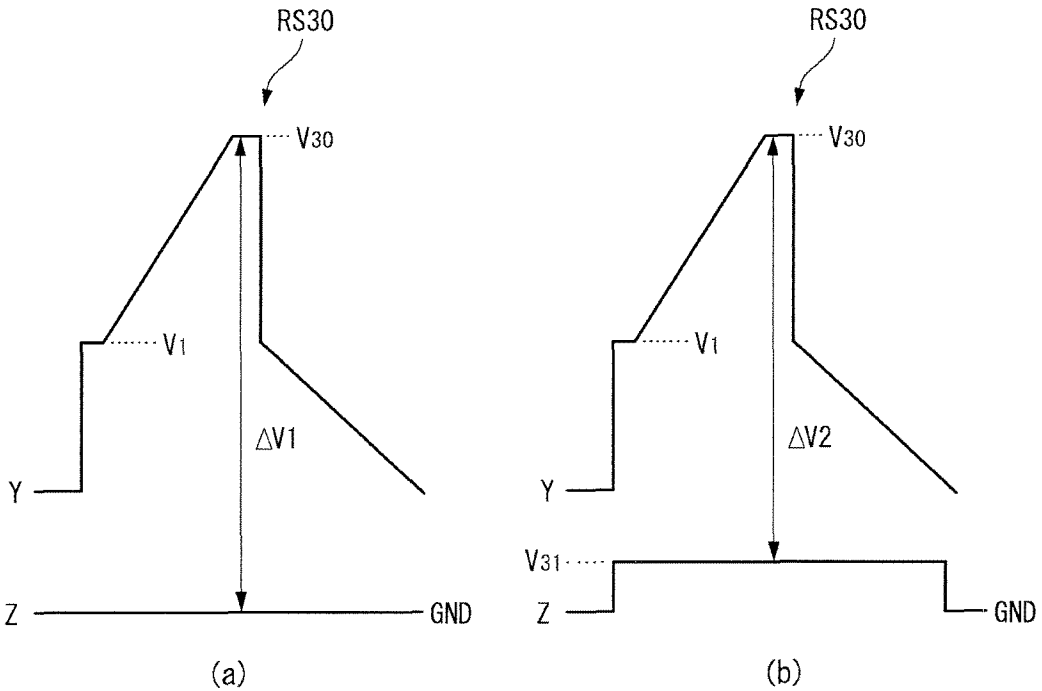
FIG. 12 illustrates a method for adjusting a voltage difference between a scan electrode and a sustain electrode in a reset period.

FIG. 12 illustrates another method for adjusting a voltage difference between the scan electrode and the sustain electrode in a reset period.

As shown in FIG. 12, a voltage difference between the scan electrode and the sustain electrode in a reset period may vary by varying a voltage of the sustain electrode in a state where a maximum voltage of a reset signal RS30 of FIG. 12(*a*) and a maximum voltage of a reset signal RS30 of FIG. 12(*b*) are substantially equal to each other.

Preferably, when the voltage difference between the scan electrode and the sustain electrode in the reset period wants to increase, the voltage of the sustain electrode is relatively lowered as shown in FIG. 12(*a*). When the voltage difference between the scan electrode and the sustain electrode in the reset period wants to decrease, the voltage of the sustain electrode is relatively raised as shown in FIG. 12(*b*).

Figure 13:
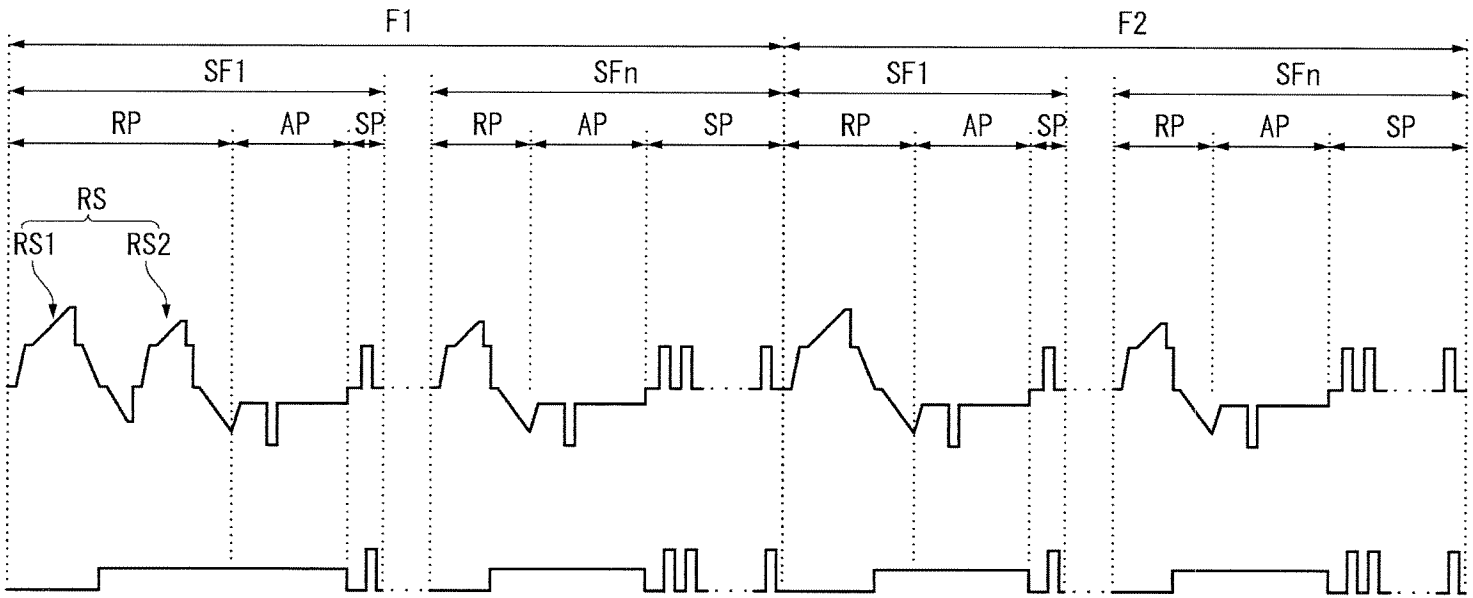
FIGS. 13 and 14 illustrate a method for adjusting the number of reset signals.
Figure 14:
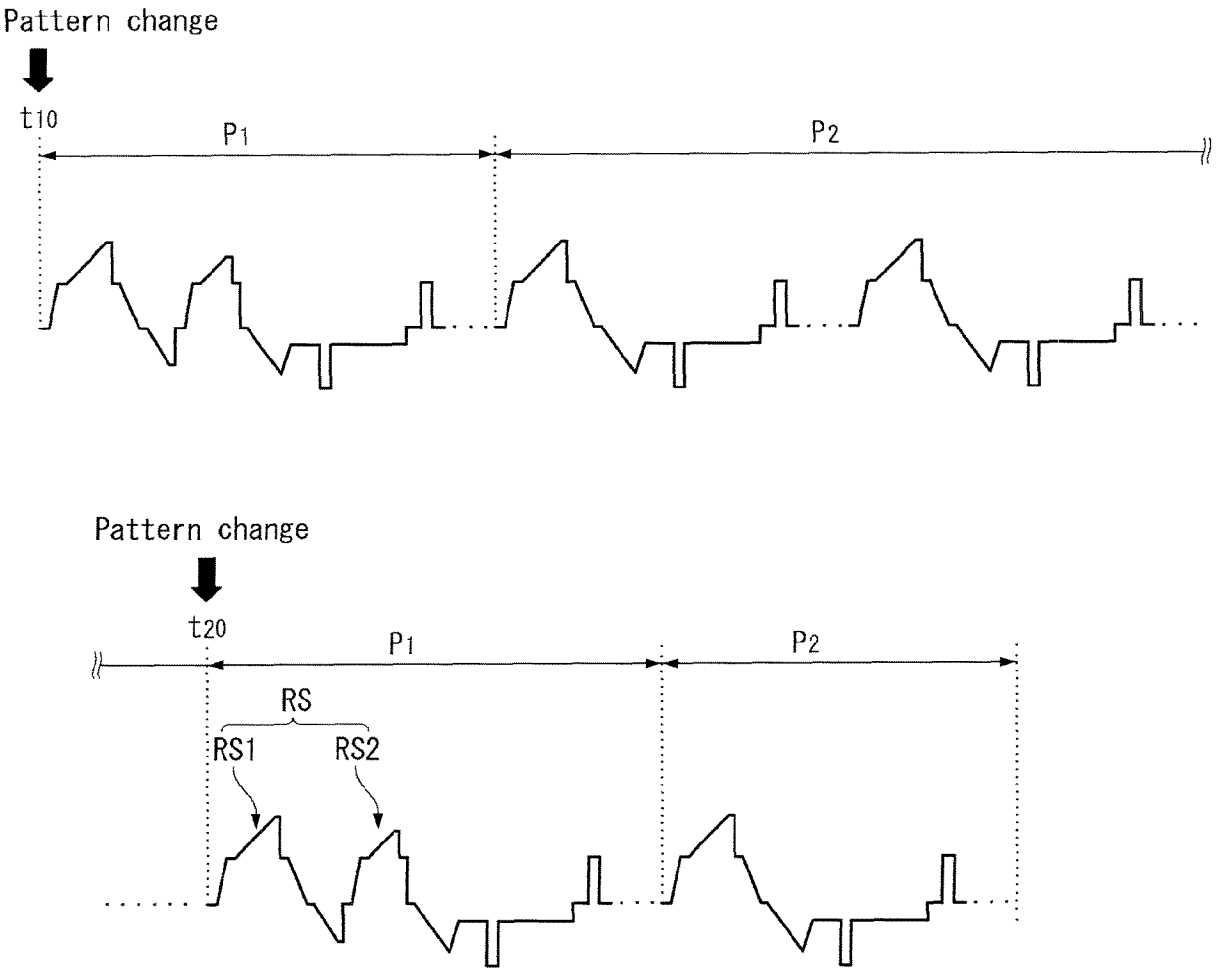

FIGS. 13 and 14 illustrate a method for adjusting the number of reset signals.

As shown in FIG. 13, the number of reset signals supplied to the scan electrode in reset periods of subfields of any two frames may be different from each other. For example, as shown in FIG. 13, the number of reset signals supplied to the scan electrode in a reset period of a first subfield SF1 of a first frame F1 is two, and the number of reset signals supplied to the scan electrode in a reset period of a first subfield SF1 of a second frame F2 is one.

An increase in the number of reset signals may stabilize a reset discharge to thereby improve the driving margin, similar to an effect obtained by an increase in the voltage difference between the scan electrode and the sustain electrode in the reset period as illustrated in FIGS. 5 to 8.

The fact that two reset signals RS and RS2 are supplied to the scan electrode in the first subfield SF1 of the first frame F1 in FIG. 13 may correspond to the increase in the voltage difference between the scan electrode and the sustain electrode illustrated in FIGS. 5 to 8.

Alternatively, as shown in FIG. 14, when a pattern of input video data changes, the number of reset signals supplied to the scan electrode may increase.

A method illustrated in FIG. 14 may correspond to an increase in the voltage difference between the scan electrode and the sustain electrode in the pattern change mode as described above. In other words, the method for increasing the number of reset signals supplied to the scan electrode in the pattern change mode may replace the method for increasing the voltage difference between the scan electrode and the sustain electrode in the pattern change mode.

An improvement width of the driving margin obtained when three or more reset signals are supplied to the scan electrode is much less than an improvement width of the driving margin obtained when two reset signals are supplied to the scan electrode. However, an amount of visible light generated during a reset period through the supply of the three or more reset signals may greatly increase, and thus the contrast characteristic may worsen.

Accordingly, the maximum number of reset signals may be determined to the extent that the driving margin is improved without worsening the contrast characteristic. For this, the maximum number of reset signals supplied to the scan electrode in the reset period may be two. In other words, two reset signals may be supplied to the scan electrode in a reset period of a subfield in which a voltage difference between the scan electrode and the sustain electrode is relatively large in a pre-reset period. One reset signal may be supplied to the scan electrode in a reset period of a subfield in which a voltage difference between the scan electrode and the sustain electrode is relatively small in a pre-reset period.

Figure 15:
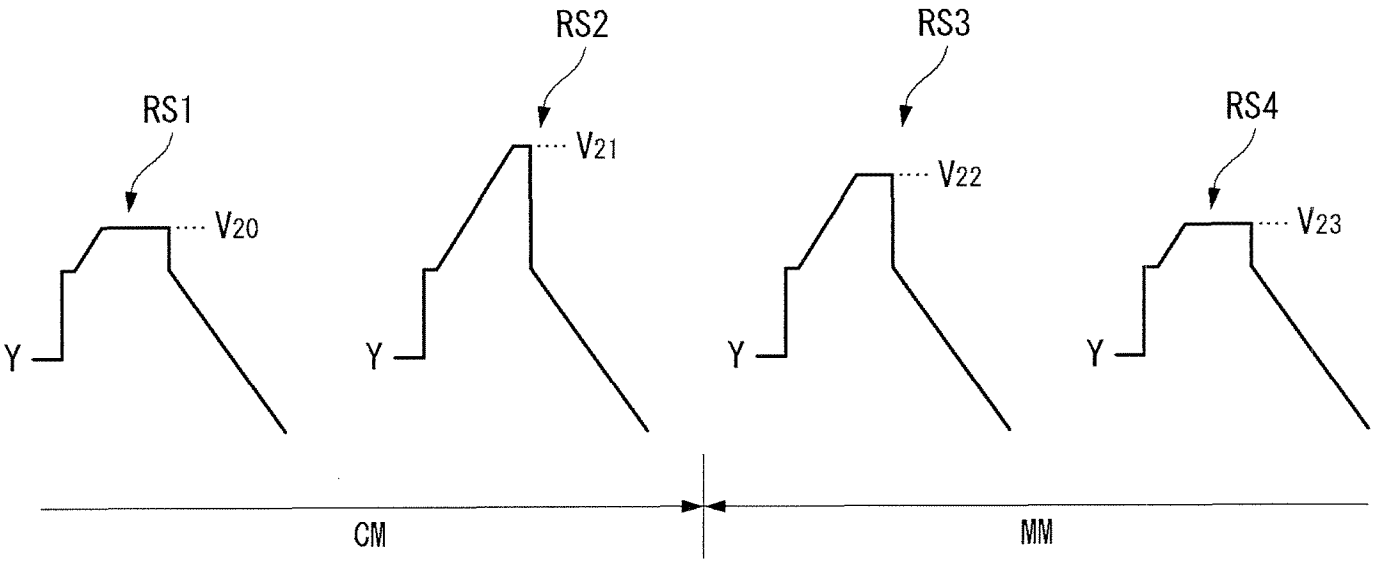
FIGS. 15 to 17 illustrate another exemplary method of driving a plasma display apparatus according to changes in a pattern of video data.
Figure 16:
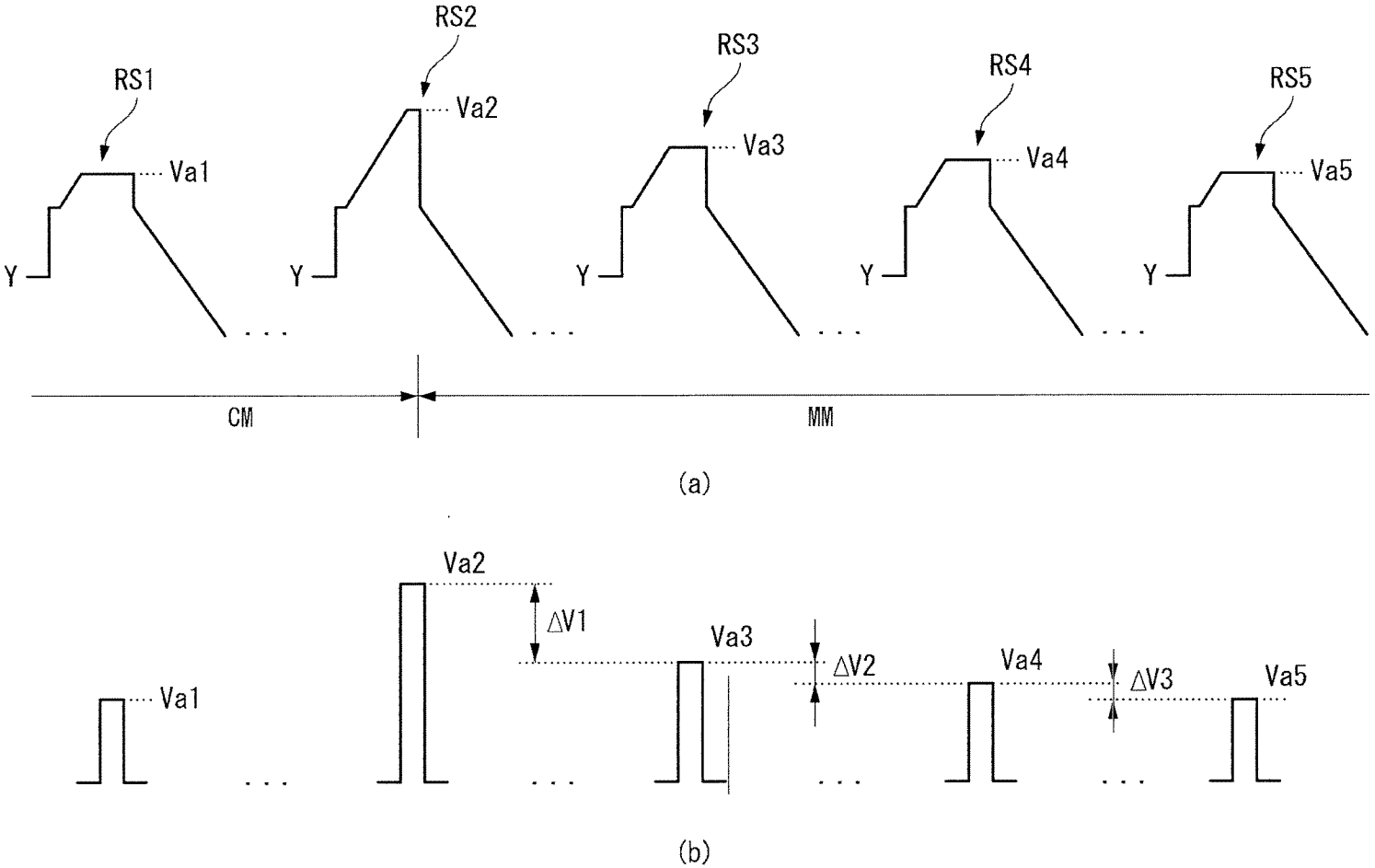
Figure 17:
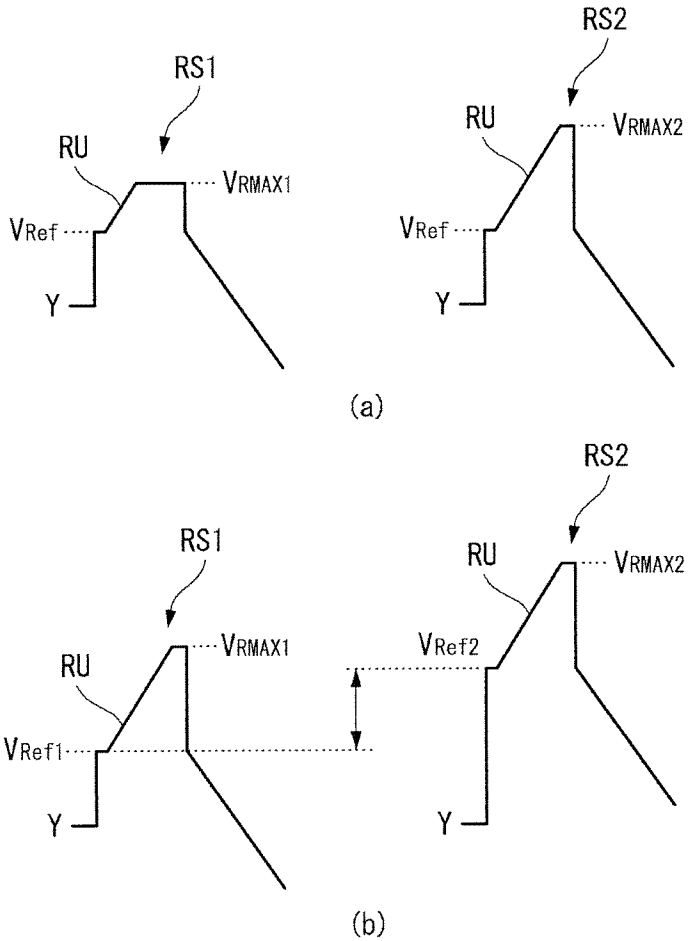

FIGS. 15 to 17 illustrate another exemplary method of driving a plasma display apparatus according to changes in a pattern of video data. The description of structures and components identical or equivalent to those illustrated above may be briefly made or may be entirely omitted.

A reset period of a subfield may include a period, in which a voltage of a reset signal supplied to the scan electrode Y decreases, in a pattern hold mode in which a pattern of input video data does not change and remains in a previous pattern. Further, a reset period of a subfield may include a period, in which a voltage of a reset signal supplied to the scan electrode Y increases, in a pattern change mode in which a pattern of input video data changes.

For example, as shown in FIG. 15, a maximum voltage of a reset signal may increase from V20 to V21 in a pattern change mode CM. More specifically, in the pattern change mode CM, a first reset signal RS1 having a maximum voltage V20 may be supplied to the scan electrode Y in a reset period of a first subfield, and then a second reset signal RS2 having a maximum voltage V21 greater than the maximum voltage V20 may be supplied to the scan electrode Y in a reset period of a second subfield subsequent to the first subfield.

Further, a reduction amount of a voltage of the reset signal may increase in a first half period of a period operating in the pattern hold mode, and a reduction amount of the voltage of the reset signal may decrease in a second half period of the period operating in the pattern hold mode.

For example, as shown in (a) of FIG. 16, it is assumed that a voltage of a reset signal increases from Va1 to Va2 in a pattern change mode CM, and then the reset signal enters in a pattern hold mode MM.

In this case, in a first half period of a period operating in the pattern hold mode MM, a second reset signal RS2 may be supplied to the scan electrode Y in a subfield, and then a third reset signal RS3 may be supplied to the scan electrode Y in another subfield. A difference between a maximum voltage of the second reset signal RS2 and a maximum voltage of the third reset signal RS3 is ΔV1 shown in (b) of FIG. 16. Subsequently, in a second half period of the period operating in the pattern hold mode MM, a fourth reset signal RS4 may be supplied to the scan electrode Y in a subfield, and then a fifth reset signal RS5 may be supplied to the scan electrode Y in another subfield. A difference between a maximum voltage of the fourth reset signal RS4 and a maximum voltage of the fifth reset signal RS5 is ΔV3 shown in (b) of FIG. 16. In this case, the difference ΔV1 is greater than the difference ΔV3.

Because the human eye is centered on a pattern change in an initial period of a period operating in a pattern change mode of video data, the human cannot perceive a luminance change with his or her eyes. On the other hand, the human may easily perceive a luminance change with his/her eyes in a period operating in a pattern hold mode of video data. Considering this, a reduction amount of a voltage of a reset signal may increase in a first half period of the period operating in the pattern hold mode and a reduction amount of a voltage of a reset signal may decrease in a second half period of the period operating in the pattern hold mode, so as to reduce changes in the luminance perceived through his/her eyes.

FIG. 17 illustrates an exemplary method for changing a voltage of a reset signal.

When a reset signal includes a rising signal gradually rising from a reference voltage, a voltage of the reset signal may be adjusted by adjusting a maximum voltage of the rising signal.

For example, as shown in (a) of FIG. 17, while a reset signal RS1 is held at a reference voltage Vref in a pattern hold mode, a voltage of the reset signal RS1 may be reduced by reducing a voltage of a rising signal RU in the pattern hold mode. Further, while a reset signal RS2 is held at the reference voltage Vref in a pattern change mode, a voltage of the reset signal RS1 may increase by increasing a voltage of a rising signal RU in the pattern change mode.

Unlike the description of (a) of FIG. 17, as shown in (b) of FIG. 17, when a reset signal includes a rising signal gradually rising from a reference voltage, a voltage of the reset signal may be adjusted by adjusting the reference voltage.

For example, while a rising signal RU of a reset signal RS1 is held at a predetermined voltage in a pattern hold mode, a voltage of the reset signal RS1 may be reduced by reducing a reference voltage in the pattern hold mode. Further, while a rising signal RU of a reset signal RS2 is held at a predetermined voltage in a pattern change mode, a voltage of the reset signal RS2 may increase by increasing a reference voltage in the pattern change mode.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display apparatus comprising:

a plasma display panel including a scan electrode and a sustain electrode that are positioned parallel to each other; and a driver that allows a change amount of a voltage difference between the scan electrode and the sustain electrode in a reset period of a subfield during a pattern hold mode in which a pattern of input video data remains in a previous pattern to be different from a change amount of a voltage difference between the scan electrode and the sustain electrode in a reset period of a subfield during a pattern change mode in which the pattern of the video data changes, wherein, when a voltage difference between the scan electrode and the sustain electrode in a reset period of a first subfield of a first frame of a plurality of frames is a first value, a voltage difference between the scan electrode and the sustain electrode in a reset period of a first subfield of a second frame following the first frame is a second value, a voltage difference between the scan electrode and the sustain electrode in a reset period of a first subfield of a third frame following the second frame is a third value, and a voltage difference between the scan electrode and the sustain electrode in a reset period of a first subfield of a fourth frame following the third frame is a fourth value, a difference between the first value and the second value is greater than a difference between the second value and the third value and a difference between the third value and the fourth value, wherein a data change amount between the first frame and the second frame is greater than a critical change amount, wherein a data change amount between the second frame and the third frame is less than the critical change amount, wherein a data change amount between the third frame and the fourth frame is less than the critical change amount, wherein a peak voltage of a reset signal applied to the scan electrode during the reset period of the first subfield of the first frame is referred to as a first voltage, wherein a peak voltage of a reset signal applied to the scan electrode during the reset period of the first subfield of the second frame is referred to as a second voltage, the second voltage being greater than the first voltage, wherein a peak voltage of a reset signal applied to the scan electrode during the reset period of the first subfield of the third frame is referred to as a third voltage, the third voltage being less than the second voltage, and wherein a peak voltage of a reset signal applied to the scan electrode during the reset period of the first subfield of the fourth frame is referred to as a fourth voltage, the fourth voltage being less than the third voltage.

2. The plasma display apparatus of claim 1, wherein the change amount of the voltage difference between the scan electrode and the sustain electrode in the reset period during the pattern hold mode is less than the change amount of the voltage difference between the scan electrode and the sustain electrode in the reset period during the pattern change mode.

3. The plasma display apparatus of claim 1, wherein the voltage difference between the scan electrode and the sustain electrode in the reset period decreases during the pattern hold mode, and wherein the voltage difference between the scan electrode and the sustain electrode in the reset period increases during the pattern change mode.

4. The plasma display apparatus of claim 1, wherein the first subfield of the first frame, the first subfield of the second frame, the first subfield of the third frame, and the first subfield of the fourth frame have the same weight value and are arranged in the same location in the corresponding frame.

5. The plasma display apparatus of claim 1, wherein the difference between the first value and the second value is substantially equal to a sum of the difference between the second value and the third value and the difference between the third value and the fourth value.

6. The plasma display apparatus of claim 1, wherein the first voltage is substantially equal to the fourth voltage.

7. A plasma display apparatus comprising:

a plasma display panel including a scan electrode and a sustain electrode that are positioned parallel to each other; and a driver that allows a change amount of a voltage difference between the scan electrode and the sustain electrode in a reset period of a subfield during a pattern hold mode in which a pattern of input video data remains in a previous pattern to be different from a change amount of a voltage difference between the scan electrode and the sustain electrode in a reset period of a subfield during a pattern change mode in which the pattern of the video data changes, wherein, when a voltage difference between the scan electrode and the sustain electrode in a reset period of a first subfield of a first frame of a plurality of frames is a first difference value, a voltage difference between the scan electrode and the sustain electrode in a reset period of a first subfield of a second frame following the first frame is a second difference value, a voltage difference between the scan electrode and the sustain electrode in a reset period of a first subfield of a third frame following the second frame is a third difference value, and a voltage difference between the scan electrode and the sustain electrode in a reset period of a first subfield of a fourth frame following the third frame is a fourth difference value, a difference between the first difference value and the second difference value is greater than a difference between the second difference value and the third difference value and a difference between the third difference value and the fourth difference value, wherein a peak voltage of a reset signal applied to the scan electrode during the reset period of the first subfield of the first frame is a first peak voltage, wherein a peak voltage of a reset signal applied to the scan electrode during the reset period of the first subfield of the second frame is a second peak voltage, wherein a peak voltage of a reset signal applied to the scan electrode during the reset period of the first subfield of the third frame is a third peak voltage, wherein a peak voltage of a reset signal applied to the scan electrode during the reset period of the first subfield of the fourth frame is a fourth peak voltage, and wherein the second peak voltage is greater than the first peak voltage, the third peak voltage is less than the second peak voltage, and the fourth peak voltage is less than the third peak voltage.

8. The plasma display apparatus of claim 7, wherein a change amount of data between the first frame and the second frame is greater than a predetermined level of the change amount of data, wherein a change amount of data between the second frame and the third frame is less than the predetermined level of the change amount of data, and wherein a change amount of data between the third frame and the fourth frame is less than the predetermined level of the change amount of data.

9. The plasma display apparatus of claim 7, wherein the first subfield of the first frame, the first subfield of the second frame, the first subfield of the third frame, and the first subfield of the fourth frame arranged in the same location in the corresponding frame have the same weight value.

10. The plasma display apparatus of claim 7, wherein the difference between the first difference value and the second difference value is substantially equal to a sum of the difference between the second difference value and the third difference value and the difference between the third difference value and the fourth difference value.

11. The plasma display apparatus of claim 7, wherein the first peak voltage is substantially equal to the fourth peak voltage.

* * * * *